United States Patent [19]

Koike

[11] Patent Number: 4,485,716

[45] Date of Patent: Dec. 4, 1984

[54] METHOD OF PROCESSING PERFORMANCE DATA

[75] Inventor: Tatsuhiro Koike, Hamakita, Japan

[73] Assignee: Nippon Gakki Seizo Kabushiki Kaisha, Hamamatsu, Japan

[21] Appl. No.: 498,780

[22] Filed: May 27, 1983

[30] Foreign Application Priority Data

Jun. 2, 1982 [JP] Japan ..... 57-94363

[51] Int. Cl.[3] ..... G10F 1/00

[52] U.S. Cl. ..... 84/1.03; 84/DIG. 12

[58] Field of Search ..... 84/1.01, 1.03, 1.24, 84/DIG. 12

[56] References Cited

U.S. PATENT DOCUMENTS 4,402,244 9/1983 Nakada et al. ..... 84/1.03
4,413,543 11/1983 Iba ..... 84/1.03
4,432,266 2/1984 Nakada ..... 84/1.03

*Primary Examiner*—Forester W. Isen
*Attorney, Agent, or Firm*—Spensley, Horn, Jubas & Lubitz

[57] ABSTRACT

When a player plays a musical piece on a keyboard of a musical instrument, the instrument provides an event datum at every event of the key depression and key release. The event datum includes information on the time of such depression or release and information on the note pitch. Thus a sequential train of these event data constitutes performance data which represents the progression of the music actually played. According to a reference tempo clock, a barline datum indicative of the time for a barline is provided at every period of a time length which defines a measure. Where the performance data exhibits the existence of a note pitch at the time of the barline and then if the time difference between the barline timing and the immediately preceding event is shorter than a predetermined time length, the performance data is adjusted so that this preceding event should fall on the barline timing, but if not shorter and then if the time difference between the barline timing and the immediately succeeding event is shorter than a predetermined time length, the performance data is adjusted so that this succeeding event should fall on the barline timing. Where the performance data exhibits the non existence of a note pitch at the time of the barline and if the time difference between the barline timing and the immediately succeeding event is shorter than a predetermined time length, the performance data is adjusted so that this succeeding event should fall on the barline timing. Thus, there is obtained adjusted performance data free from unintended and unnecessarily precise locations of barlines with respect to notes and rests.

5 Claims, 20 Drawing Figures

METHOD OF PROCESSING PERFORMANCE DATA

BACKGROUND OF THE INVENTION (a) Field of the Invention

The present invention relates to a method of processing performance data obtained from, for example, a live performance, and more particularly it pertains to a method of processing performance data so as to amend the specific performance data occurring before or after a barline timing to insure that a correct music score is, for example, printed out.

(b) Description of the Prior Art

There has been known a performance recording apparatus for use in, for example, an automatic performance apparatus provided in a keyboard musical instrument such as electronic organ and piano and arranged to produce and store a performance data from the states of the keys being operated by an instrument player, and to read out this stored performance data and reproduce musical tones, and to thereby cause the musical instrument to effect an automatic playing of the music composition having been played by the instrument player. In such known apparatus, it has been usual to store the abovesaid performance data in the order of progression of the music composition by using the note data represented by key codes indicative of the depressed keys and by the note duration data indicative of the durations of respective depressions of said keys and also by using rest data represented by the zero key code indicative of the absence of a depressed key and by the rest duration data indicative of the length of time in which no key is depressed. And, in such known apparatus, arrangement is provided to amend the unintended errors in the performance timings of the instrument player (such as errors in the key depression timings and/or the key release timings), when a performance data is to be stored, by rounding off the respective note or rest duration data of said note data and rest note data so that they each will become a multiple of a minimum duration unit.

However, in such known apparatus, when it is intended to form a music score by printing out a stored performance data, it should be noted that, even in case an amendment is made in such a known processing method as described above, the presence of an error before or after a barline timing in the performance timing on the part of the instrument player will be printed out before or after a barline in the form of a note or a rest of a very short duration (for example, the duration of said minimum duration unit), with the result that there will be eventually printed out a music score which is different from the score of the music composition which the player believes he has played.

SUMMARY OF THE INVENTION

It is, therefore, an object of the present invention to provide a method of processing performance data such that, in case a music score is to be printed out by using a performance data obtained from, for example, a performance done by an instrument player, said performance data is processed and amended so that the note or the rest present before or after the barline may be printed out free from performance error.

Another object of the present invention is to provide a method of processing performance data as described above, which is arranged that, in case a barline timing is included in a note and also in case the timing discrepancy between this barline timing and a note change timing present immediately before or immediately after said barline timing is shorter than a predetermined length of time, said note change timing is regarded to fall on the barline timing.

Still another object of the present invention is to provide a method of processing performance data as described above, which is arranged that, in case a barline timing is included in a rest and also in case the timing discrepancy between this barline timing and a note start timing present immediately after said barline timing is shorter than a predetermined length of time, said note start timing is regarded to fall on the barline timing.

According to the method of processing performance data of the present invention, arrangement is provided so that in case a barline timing is included in a note and also in case the timing discrepancy between this barline timing and a note change timing present immediately before or immediately after said barline timing is shorter than a predetermined length of time, said note change timing is regarded as the barline timing, and on the other hand in case a barline timing is included in a rest and also in case the timing discrepancy between this barline timing and a note start timing present immediately after said barline timing is shorter than said predetermined length of time, said note start timing is regarded as the barline timing. Accordingly, in case a music score is printed out by using the performance data having been processed by this method, it should be noted that, even when the player of a musical instrument has made a performance with an error in the note duration before or after a barline timing (i.e. has made an unskilled performance), still it is possible to print out a correct music score. Also, by arranging so that an automatic performance is effected by using the performance data processed according to this method, it will be noted that, since the performance data is in perfect synchronism with a predetermined clock pulse, the controlling of operation timing of an automatic rhythm producing device which is added becomes very conveniently simple and easy, and furthermore in case it is intended to play a music in ensemble with other musical instruments, it becomes very easy to make the tempo of such other musical instruments accompany the automatic playing.

DETAILED DESCRIPTION OF THE PREFERRED EMBODIMENTS

Description will hereunder be made, by referring to the accompanying drawings, of an embodiment in case the method of processing performance data according to the present invention is applied to a performance recording device of an electronic organ.

Figure 1:
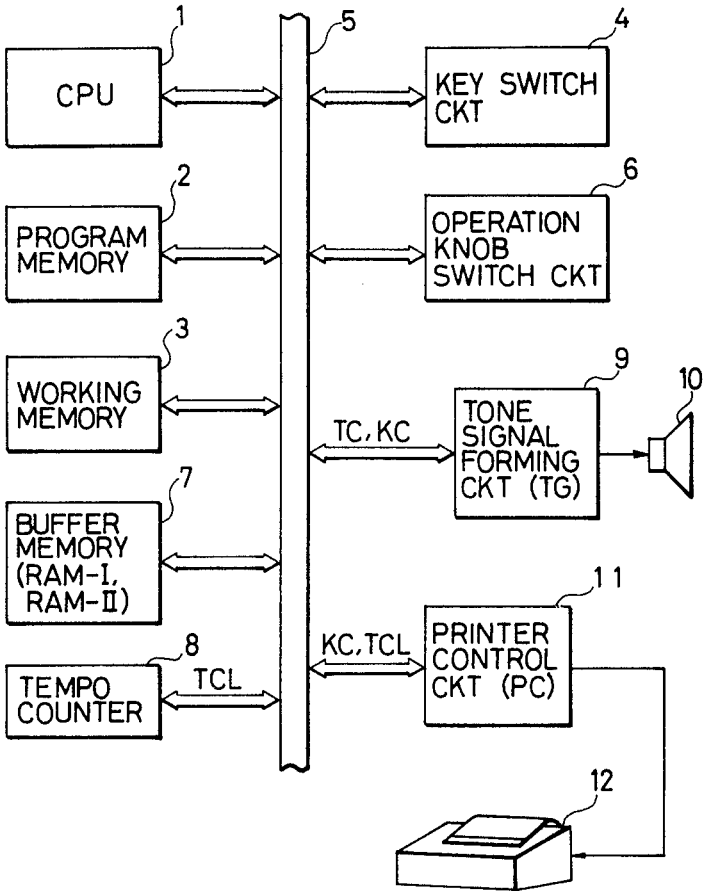
FIG. 1 is a block diagram showing the arrangement of an embodiment of the present invention in case it is applied to an electronic organ.

First of all, an outline of the arrangement of the electronic organ in this embodiment will be described by referring to FIG. 1. The electronic organ illustrated therein is arranged so as to conduct a concentrated control of the performance recording device as a whole by using a central processing unit (hereinafter to be referred to as CPU) such as a micro-processor. In FIG. 1, reference numeral 1 represents said CPU. Also, a program memory 2 is a read-only memory in which various kinds of programs which are used by said CPU 1 are stored. Also, a working memory 3 is a memory for the working areas used by said CPU 1 during its course of operation, and it is comprised of random access memory. In this instance, a part of the addresses of this working memory 3 are used as, for example, external registers and pointers of the CPU 1.

Next, a key switch circuit 4 is a circuitry comprised of key switches which are provided one for one key of the keyboard of this electronic organ. By scanning these key switches via a signal bus 5, the CPU 1 is able to detect the operating state of the respective keys of the keyboard. Also, an operating knob switch circuit 6 is a circuitry for outputting contact signals representing the state of the switch contacts of respective operating knobs such as tone color selecting switches, rhythm selecting switches or a print start switch for commanding the printing-out of a music score, all of which switches are provided on a panel board of the electronic organ. In accordance with the interruption which is generated when the contacts of these respective operating knob switches are opened or closed, the CPU 1 reads-in the state of operation of these respective operating knobs, and rewrites the contents of the registers in said working memory 3 corresponding to these respective operating knobs. As these registers, there are used, for example, a register for storing a tone color code TC selected by said tone color selecting switch, a register for storing a rhythm pattern information of a rhythm selected by said rhythm selecting switch, or a print start register which is set when said print start switch is actuated. Next, a buffer memory 7 is a random access memory (RAM) for storing a music score data (performance data) obtained from the key operating states of the keyboard. This buffer memory 7 is comprised of a memory RAM I for storing a performance data not processed yet, and a memory RAM II for storing a performance data processed according to the present invention. Also a tempo counter 8 is a counter for counting tempo clocks (whose period is set by the instrument player) outputted by a tempo generator not shown. This tempo counter 8 counts continuously and repetitively said tempo clocks between zero and the tempo clock number for one measure which is determined by the specific time (meter) of the rhythm producing system selected by said rhythm selecting switch, and for each count of tempo clocks for one measure, it applies an interruption to the CPU 1 to indicate that one measure has elapsed.

Next, a tone signal forming circuit (TG) 9 is a circuitry for forming (generating), based on the data supplied from the CPU 1, a corresponding tone signal and for supplying it to a loudspeaker 10 to thereby sound music tones. Also, a printer controlling circuit (PC) 11 is a circuitry for producing, based on the data supplied by the CPU 1, a printing-out data of a corresponding music score and for supplying same to a printer 12 to thereby cause the printer 12 to print out the music score on a sheet of paper of the printer 12.

With the above-mentioned arrangement, in the normal mode wherein no printing-out of a music score is carried out, the CPU 1 will, prior to the start of a performance, supply informations such as the tone color code TC of the operating knobs to TG 9 from the registers of the working memory 3. Next, upon commencement of a performance by the instrument player, the CPU 1 detects the key operating state from the open or closed state of said key switches, and supplies a key code KC indicative of a depressed key at the time a key is depressed to the tone signal forming circuit 9. This tone signal forming circuit 9 generates tone signals respectively corresponding to the pitches of the respective specific keys indicated by said key codes KC, and forms tone signals after imparting to said tone signals a tone color for example corresponding to said tone color TC, and supplies this tone signals to the loudspeaker 10.

Accordingly, in this normal mode, music tones having note pitches corresponding to the respective depressed keys are pronounced (sounded) successively from the loudspeaker 10.

Next, in case a music score print-out mode is designated as a result of actuation of said print start switch, i.e. in case the print start register in the working memory 3 is set, the CPU 1 reads successively into said memory RAM I, at the time of each key depression (including the case a key depression change takes place), a datum (this data will be called an event datum) which is comprised of a key code KC indicative a depressed key and of an output (i.e. tempo count value TCL) of the tempo counter 8 at the time the depression of said key is started; and at the time of release of this key, an event datum which is comprised of a key code "0" and of a tempo count value TCL at the time of release of the key; and at the barline timing when the tempo count TCL has reached the tempo count number for one measure, an event data which is comprised of a key code KC at said timing and of the tempo count TCL. Each time the performance data for one measure is stored, the CPU 1 amends the data present before or after the barline timing of this performance data and stores same in said memory RAM II, and supplies the performance data of this memory RAM II to a printer controlling circuit 11. This printer controlling circuit 11 converts this performance data to a printing-out data and supplies same to a printer 12.

Accordingly, in this music score printing-out mode, music notes having pitches corresponding to depressed keys are pronounced successively from the loudspeaker 10 in the order of the progression of the performance, and along therewith a music score is printed out on the sheet of paper of the printer 12.

Next, description will be made of the basic principle of the method of processing performance data according to the present invention.

Figure 2:
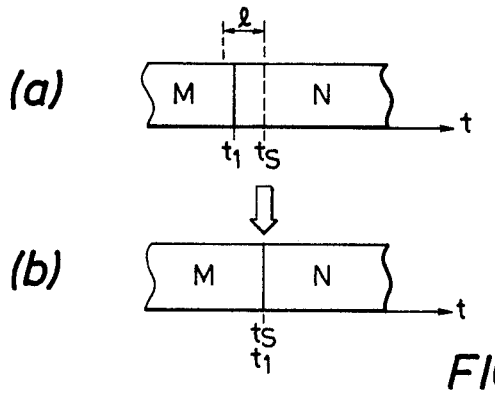
FIGS. 2 to 4 are time charts for explaining the principle of the method of processing performance data according to the present invention.
Figure 3:
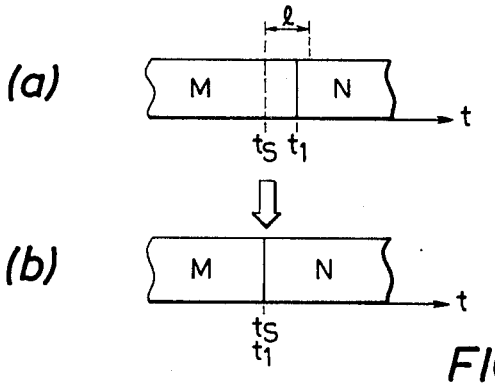
Figure 4:
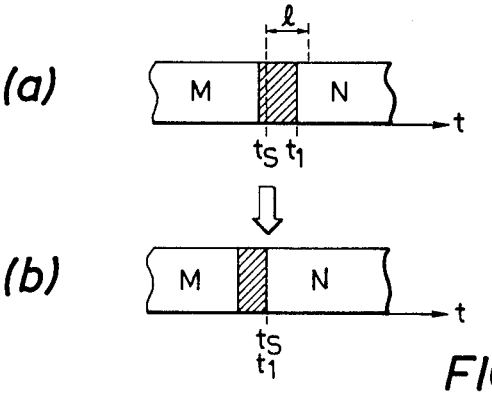

FIGS. 2 to 4 are time charts for explaining the basic principle of the present invention. In these Figures, the portion indicated by the letter M represents the period of time in which an arbitrary key M on the keyboard is being depressed. The portion indicated by the letter N represents the period of time in which an arbitrary key N of the keyboard is being depressed. The period of time indicated by hatching represents the period of time in which no key is depressed, i.e. the period of a rest. Symbol $t_s$ represents a barline timing, i.e. the timing at which said tempo count TCL has reached the tempo clock number for one measure. Also, the letter l represents the period of time corresponding to the minimum note duration unit (which, in a music composition of 4/4 time, is a note duration corresponding to, for example, 16th note).

Here, in case a change in the key depression takes place from the key M to the key N at the timing $t_1$ which locates within the period l immediately before a barline timing $t_s$, i.e. in case the instrument player makes a changeover of key depression from the final note of the current measure to the initial note of the next measure slightly earlier than the correct barline timing, said key depression change timing $t_1$ is regarded to fall on the barline timing $t_s$ in the present invention as shown in FIG. 2(*b*). Also, as shown in FIG. 3(*a*), when a change in the key depression takes place from key M over to key N at timing $t_1$ which locates within the period l immediately after the barline timing $t_S$, i.e. in case the instrument player conducts the key depression alteration from the final note of the current measure to the initial note of the next measure slightly later than the correct barline timing, said key depression timing $t_1$ is regarded in the present invention to fall on the barline timing $t_s$ as shown in FIG. 3(*b*). Also, as shown in FIG. 4(*a*), in case the release of key M is conducted at the barline timing $t_s$ or prior thereto and further the depression of key N is started at timing $t_1$ which locates within the period l immediately after the barline timing $t_s$, i.e. in case the instrument player provides a short non-key-depression period between the final note of the current measure and the initial note of the next measure, the key N depression start timing $t_1$ is regarded to fall on the barline timing $t_s$ in the present invention as shown in FIG. 4(*b*).

And, according to the basic principle discussed above, in case, for example, as shown in FIG. 5(*a*), the $C_3$ note key is released from the depressed state at timing $t_1$ within the period l immediately before the barline timing $t_s$ and the depression of the $D_3$ note key is started at timing $t_2$ after the lapse of the period l from the barline timing $t_s$, and also there is the non-key-depression period lasting from timing $t_1$ till timing $t_2$, no amendment of the barline timing $t_s$ is effected as shown in FIG. 5(*b*). Also, as shown in, for example, FIG. 6(*a*), in case the $C_3$ note key is released at timing $t_1$ within the period l immediately before the barline timing $t_s$ and the depression of the $D_3$ note key is started within the period l immediately after the barline timing $t_s$, and also a non-key-depression period lasts from timing $t_1$ till timing $t_2$, an amendment is made so that the barline timing $t_S$ be the timing $t_2$ as shown in FIG. 6(*b*). Also, as shown in, for example, FIG. 7(*a*), in case the alteration of key depression from key $C_3$ to key $D_3$ is conducted at timing $t_1$ which is earlier than the timing which is prior, by the period l, to the barline timing $t_s$ and also the alteration of key depression from key $D_3$ to key $E_3$ is conducted at timing $t_2$ which is later than the lapse of the period l from the barline timing $t_s$, no amendment of the barline timing $t_s$ is effected as shown in FIG. 7(*b*). Also, as shown in, for example, FIG. 8(*a*), in case key $C_3$ is released at timing $t_1$ within the period l immediately after the barline timing $t_s$ and the depression of key $D_3$ is commenced at timing $t_2$ after the lapse of the period l from the measure timing $t_s$, and there lasts a non-key-depression state from timing $t_1$ till timing $t_2$, an amendment is made so that the barline timing $t_s$ can be the timing $t_1$ as shown in FIG. 8(*b*), and, here, in case the period from timing $t_1$ till timing $t_2$ is shorter than the period l, a further amendment is made so that said barline timing $t_s$ the timing $t_2$ as shown in FIG. 8(*c*).

Next, the operations of the embodiment shown in FIG. 1 will be described hereunder in further detail, including the course of processing performance data based on said operation principle.

Firstly, the entire operations of this embodiment will be described by giving reference to the flow chart shown in FIG. 9.

Figure 9:
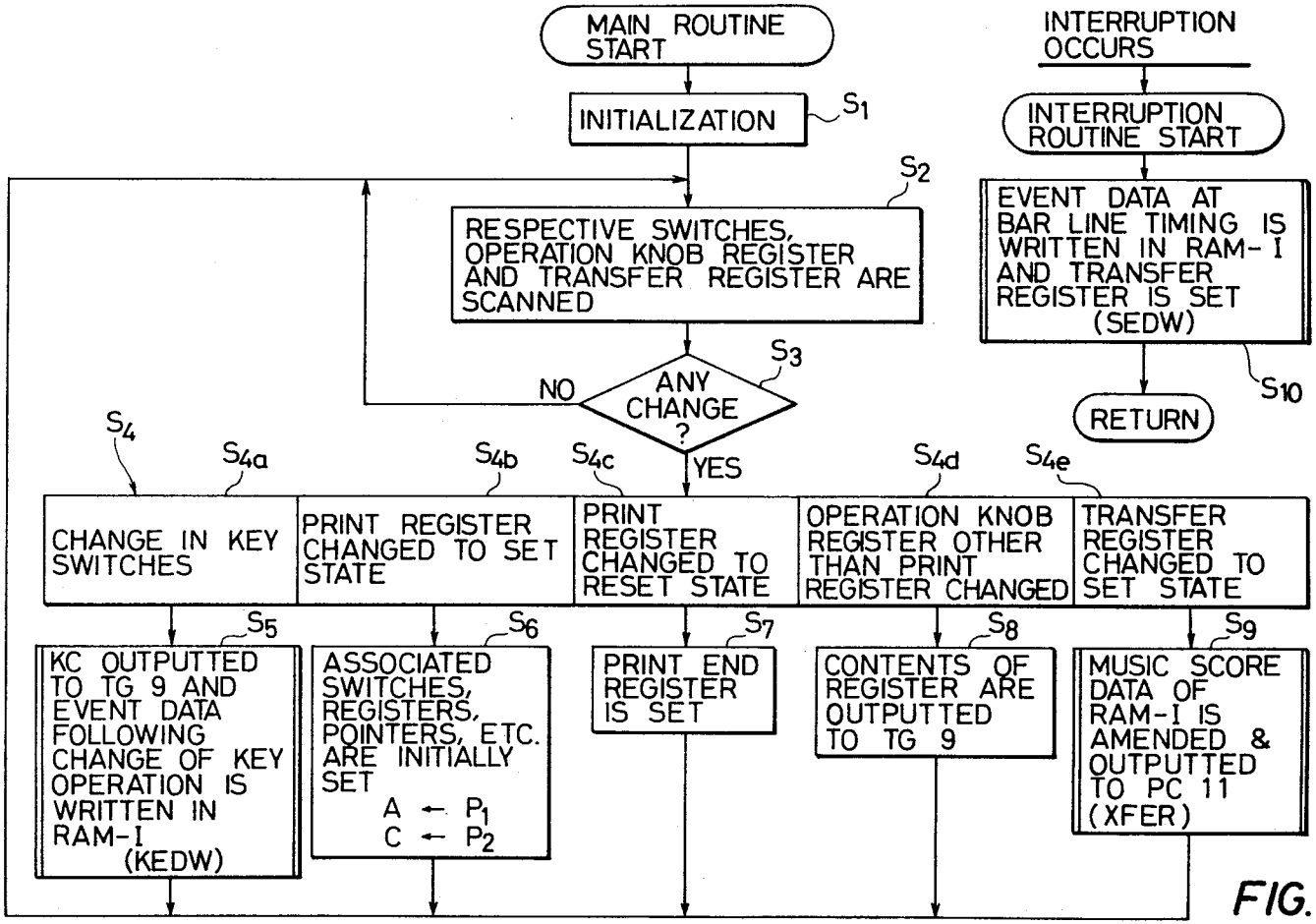
FIG. 9 is a flow chart of a main routine and an interruption routine of a CPU 1 in the embodiment shown in FIG. 1.
Figure 10:
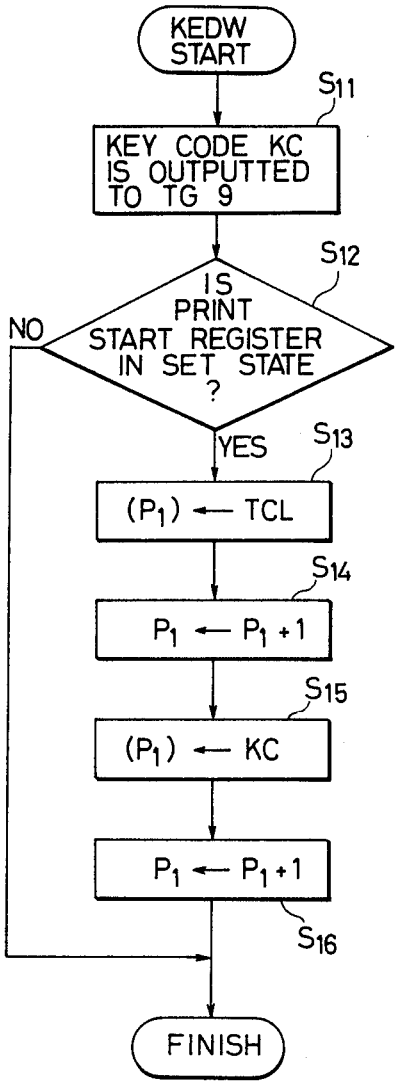
FIG. 10 is a flow chart of a program KEDW in said main routine.
Figure 11:
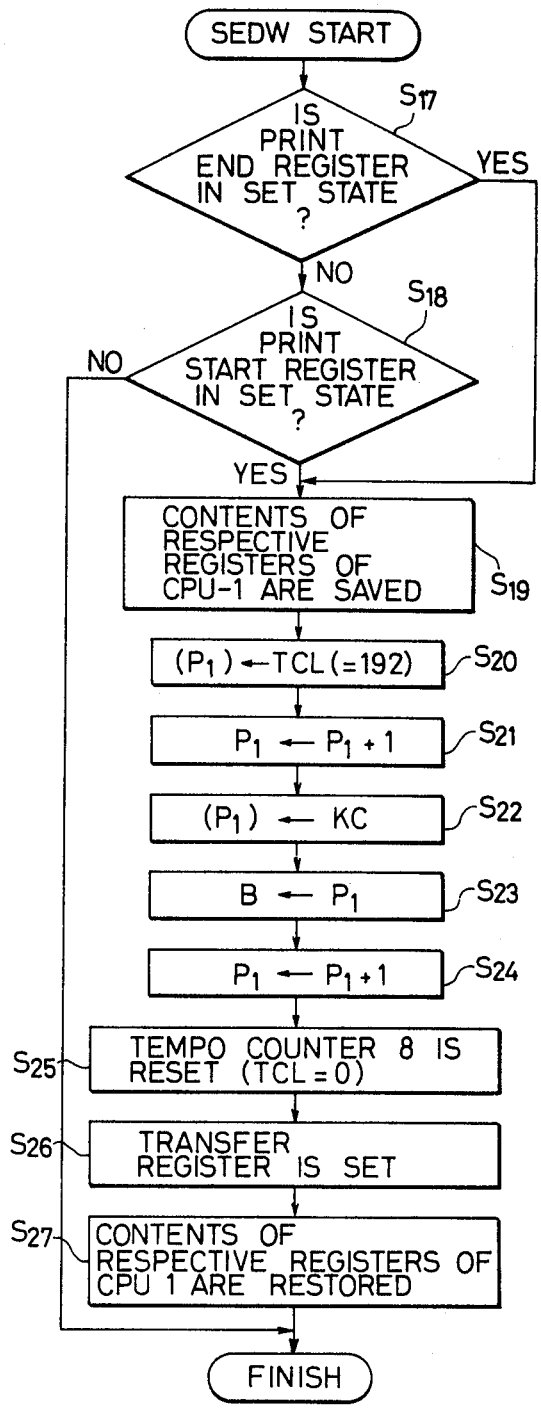
FIG. 11 is a flow chart of a program SEDW in said interrution routine.
Figure 12:
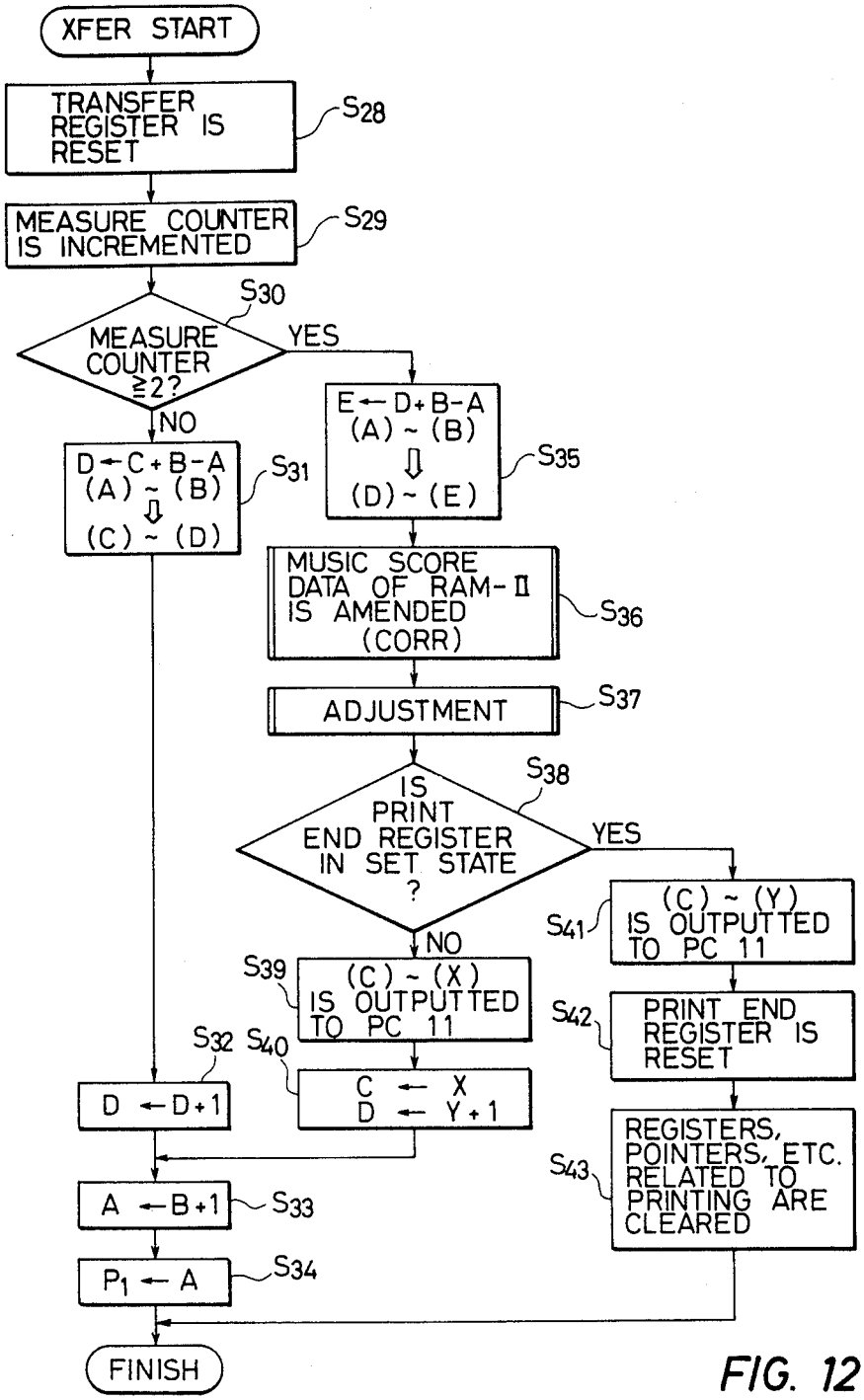
FIG. 12 is a flow chart of a program XFER in said main routine.

The flow chart shown in FIG. 9 illustrates the respective flows of the main routine (main program) which is carried out by the CPU 1 and of the interruption routine which is carried out for the interruption which takes place at a barline timing. It should be noted that, in the below-stated respective flow charts, those registers and pointers labeled by alphabetical letters such as A, B, C and D which are not enclosed in parentheses ( ) represent the contents of the corresponding registers per se or pointers per se, and those enclosed in ( ) represent the contents at the addresses pointed to by the corresponding registers or pointers.

In FIG. 9, when the operation of this electronic organ is commenced, the CPU 1 begins with initializing respective sections of the circuitry, respective registers (such as the transfer register, measure counter, print end register, which will be described later), respective buffer memories and so forth (Step $S_1$). Upon completion of this initialization, the controlling action of this CPU 1 advances to Step $S_2$ wherein it scans respective key switches, operating knob registers (such as registers for storing tone color code TC, etc., print start register, and so forth) corresponding to the respective operating knobs provided on the panel board, the transfer register which will be described later, and so forth. In case judgment is made, as a result of said scanning, that there has been effected no change in each of the sections mentioned above, the controlling operation of the CPU 1 will return again to Step $S_2$ to further continue the scanning of the abovesaid respective sections. On the other hand, in case a change is found (i.e. in case there is present a change in the key operation state or in the operation of operating knobs), the controlling action of the CPU 1 will advance to Step $S_4$ wherein there is carried out a branching in accordance with the result of said scanning. In this Step $S_4$, in case a change in the open or closed state of the key switches is found at the time of said scanning as shown by Step $S_{4a}$ of said Step $S_4$, the controlling action of the CPU 1 will advance to Step $S_5$ wherein it carries out a program KEDW. Upon completion of the carrying-out of this program KEDW, the controlling action returns to Step $S_2$. This program KEDW causes a key code KC of a depressed key to be outputted to TG 9, and concurrently therewith, in the music score printing-out mode, further causes an event data following the change in the key operating state to be written into the memory RAM I. Also, in Step $S_4$, in case the state of the print start register has changed into a set state at said scanning time as shown by Step $S_{4b}$ of said Steps $S_4$, i.e. in case the instrument player has actuated the print start switch, the controlling action of the CPU 1 advances to Step $S_6$ wherein it carries out the initialization of the respective sections which will be used at the time a music score is printed out, and thereafter it returns to Step $S_2$. In this Step $S_2$, the state of the respective switches provided on the panel board to determine the music score printing-out mode is read in to set this state into the corresponding registers, and sets respective leading (top) addresses of the memories RAM I and RAM II into pointers $P_1$ and $P_2$, respectively, and sets the contents of the pointers $P_1$ and $P_2$ into registers A and C, respectively, and furthermore clears such registers as the transfer register, the measure counter and print end register all of which will be described later, thereby carrying out the initialization. Also, in Step $S_4$, in case the state of the print start register has changed into the reset state at said scanning time as shown in its Step $S_{4c}$ of said Step $S_4$, i.e. in case the instrument player deactuates the print start switch, the controlling action of the CPU 1 will advance to Step $S_7$, wherein it will set the print end register, and then it returns to Steps $S_2$. Also, in Step $S_4$, in case the contents of the respective operating knob registers excluding the print start register have undergone a change at said scanning time as shown in its Step $S_{4d}$ of Step $S_4$, i.e. in case the instrument player has operated such operating knobs as the tone color selecting switches, the action of the CPU 1 will advance to Step $S_8$, wherein it outputs the contents of these operating knob registers to the tone signal forming circuit 9, and thereafter the controlling action returns to Step $S_2$. Also, in Step $S_4$, in case the state of the transfer register which will be described later has changed into the set state at said scanning time as shown in its Step $S_{4e}$ of Step $S_4$, the actin of the CPU 1 will advance to Step $S_9$, wherein the CPU 1 carries out a program XFER, and then its action returns to Step $S_2$. In this program XFER, the aggregation of the event data, i.e. performance data, which are stored in memory RAM I are processed in accordance with the method of the present invention, and thereafter they are outputted to the printer controlling circuit 11.

On the other hand, in case, during the course in which said main routine is being carried out, the tempo count TCL reaches the tempo clock number for one measure (i.e. has become a barline timing), causing an interruption to appear, there is started the carrying-out of an interruption routine based on said interruption. When this interruption routine is commenced, a program SEDW is carried out in Step $S_{10}$. Upon termination of this carrying-out of Step $S_{10}$, the controlling action of the CPU 1 will return to said main routine. In this program SEDW, in case the mode is the music note printing-out mode, it causes the event data at this barline timing to be written into RAM I, and thereafter it sets the transfer register. On the other hand, if the mode is the normal mode wherein no printing-out of the music score is conducted, no operation whatsoever is carried out.

Next, by referring to the flow chart of FIG. 9 and also to the respective flow charts shown in FIGS. 10 to 13, the detailed operations of this embodiment will be described in successive order for each operation mode, with respect to the instance wherein the number of tempo clocks per measure is "192" corresponding to 4/4 time, and wherein the number of tempo clocks perminimum note duration unit (i.e. the number of tempo clocks during the aforesaid period l) is "12".

Description will be made first of the normal mode wherein no music score printing-out is conducted. In this instance, when the instrument player operates such operating knobs as the tone color selecting switch prior to a performance, a change in the contents of the operating knob registers are detected in Steps $S_2$ and $S_3$ of the main routine, and Step $S_8$ is carried out through Step $S_{4d}$. As a result, those operating knob informations as the tone color code TC are outputted to the music note signal forming circuit 9. Then, as the instrument player commences a key operation, a change in the state of the key switch is detected in Steps $S_2$ and $S_3$. For each detection of this change of state, the program KEDW of Step $S_5$ is carried out through Step $S_{4a}$. Here, by giving reference to the flow chart of the program KEDW shown in FIG. 10, it will be noted that, in this program KEDW, firstly the key code KC of the currently depressed key (in case of no depressed key, zero key code KC) is outputted to the tone signal forming circuit 9 in Step $S_{11}$. As a result, the sounding of the music tone corresponding to the depressed key is started. Then, in Step $S_{12}$, the state of the print start register is judged. In such instance, since said register is in its reset state, said program KEDW immediately ends, and the controlling action returns again to Step $S_2$ in the flow chart of FIG. 9. Accordingly, each time the key operating state undergoes a change, the program KEDW of Step $S_5$ will become carried out. On the other hand, when the abovesaid tempo count TCL arrives at a value "192" and when accordingly, an interruption arises, the program SEDW of Step $S_{10}$ is carried out. Here, by giving reference to the flow chart of the program SEDW shown in FIG. 11, it will be noted that, in this program SEDW, firstly the state of the print end register is judged in Step $S_{17}$. Since, in this instance, said register is in its reset state, the control will advance to Step $S_{18}$, and the state of the print start register is judged. In this instnace, said register is in its reset state, and accordingly, this program SEDW ends immediately. That is, in this mode, even when the program SEDW is carried out, no data processing is carried out. It should be understood here that, in case the instrument player operates the operating knobs provided on the panel board during the performance, the contents of the corresponding operating knob registers will alter at each such timing, and in response thereto, the Step $S_8$ of FIG. 9 will be carried out. Accordingly, it is possible to change such conditions as the pronunciation of the music note even in the midst of the performance.

And, in this normal mode, when the keyboard is operated to play a music composition, music notes corresponding to this music composition are sounded out in succession in the selected sounding conditions.

Next, description will be made of the music score printing-out mode. In this instance, the operations in case the instrument player operates the operating knobs on the panel board prior to a performance are similar to the operations in the abovesaid normal mode. Then, when the instrument player actuates the print start switch to command the commencement of the printing-out of a music score, the print start register becomes set. Accordingly, in the Steps $S_2$ and $S_3$ of FIG. 9, the change in the contents of said print start register is detected, and as a result Step $S_6$ is carried out through Step $S_{4b}$. In this Step $S_6$, as stated above, the state of the respective switches which jointly determine the music score printing-out mode is set in the respective registers, and the address of the leading address of the memory RAM I is set in the pointer $P_1$, and the address at the leading address of the memory RAM II is set in the pointer $P_2$, and the content of the pointer $P_1$ is set in the register A, whereas the content of the pointer $P_2$ is set in the register C. Also, the transfer register, the measure counter for counting the number of the measures, and the print end register are cleared respectively.

Next, upon commencement of a key operation by the instrument player, the program KEDW of Step $S_5$ is carried out each time the key operating state changes. Here, let us assume that the depression of the key corresponding to the first note of the music composition is started. In this instance, the carrying-out of the program KEDW is started, and in Step $S_{11}$ of FIG. 10, the key code KC of said first key, i.e. the first key code $KC_{1-1}$ of the first measure, is outputted to the tone signal forming circuit 9. Then, in Step $S_{12}$, the state of the print start register is judged. Since, in this instance, the print start register is in its set state, Steps $S_{13}$ to $S_{16}$ are carried out in successive order. That is, in this instance, the tempo count TCL at such timing, i.e. the tempo count $TCL_{1-1}$ at the first key operation change timing of the first measure (this tempo count $TLC_{1-1}$ is zero, because the tempo counter 8 is reset at the initial key depression commencement timing when the performance is started, allowing the synchronism of rhythm to be obtained), is stored in the address pointed to by the pointer $P_1$, i.e. in the leading (top) address of the memory RAM I (Step $S_{13}$), and then the pointer $P_1$ is incremented (Step $S_{14}$), and then said first key code $KC_{1-1}$ is stored in the address pointed to by the pointer $P_1$, i.e. in the second address of the memory RAM I (Step $S_{15}$), and then the pointer $P_1$ is incremented (Step $S_{16}$). In this way, the event data concerning the change in the initial key operating state are stored.

Next, let us assume that the instrument player conducts a key depression change from the key of the abovesaid first note to the key of the second note. Whereupon, the program KEDW is carried out again. In this instance, in Step $S_{11}$ of FIG. 10, the key code $KC_{1-2}$ corresponding to the key of the second note is outputted to the tone signal forming circuit 9. Also, in Step $S_{13}$, the tempo count TCL at this key depression change timing, i.e. the tempo count $TCL_{1-2}$ at the second key operation change timing, is stored in the 3rd address of the memory RAM I. Also, in Step $S_{15}$, said second key code $KC_{1-2}$ is stored in the 4-th address of the memory RAM I.

Figure 14:
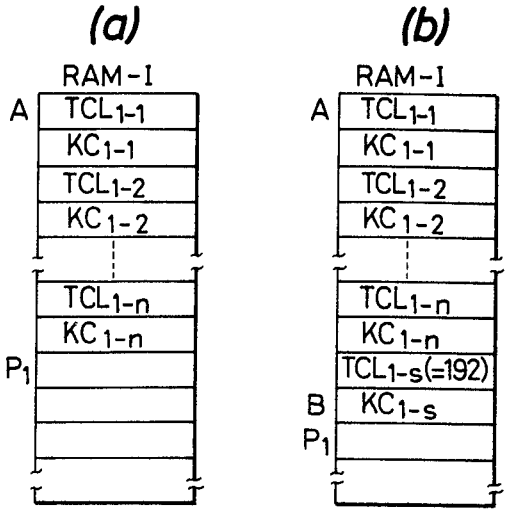
FIG. 14 is an illustration showing the stored state of event data for explaining the operation of the program KEDW.

Subsequently, in the similar way as described above, each time the key operating state undergoes a change, the event data at such key operation change timing are written in the memory RAM I in successive fashion. Accordingly, the state of storage of the respective event data in the memory RAM I immediately after the key operating state has changed n times will become as shown in FIG. 14(*a*). It should be noted here that, in such instance, the register A points to the leading address of the memory RAM I, and also the pointer $P_1$ points to the next address of that address in which the key code $KC_{1-n}$ is stored, as shown.

Next, let us now assume that, after the n-th key operation change timing, the tempo count TCL has reached the value "192", and that, as a result, an interruption has arisen. Whereupon, the program SEDW of Step $S_{10}$ of FIG. 9 is carried out. When the carrying-out of this program SEDW is commenced, the state of the print end register is judged in Step $S_{17}$ of FIG. 11. Since, in this instance, said register is in its reset state, the control advances to Step $S_{18}$, and the state of the print start register is judged. Since, in this instance, said register is in its set state, Steps $S_{19}$ to $S_{27}$ are carried out in successive fashion. That is, in this instance, the contents of the respective registers of the CPU 1 are saved (Step $S_{19}$), and then the tempo count TCL at this timing (this tempo count TCL (=192) is assumed to be $TCL_{1-s}$ since it corresponds to the barline timing of the first measure), i.e. the value "192", is stored in the address pointed to by the pointer $P_1$ (Step $S_{20}$), and then the pointer $P_1$ is incremented (Step $S_{21}$), and then the key code KC at this timing (this is designated as the key code $KC_{1-s}$) is stored in the address pointed to by the pointer $P_1$ (Step $S_{22}$), and then the content of the pointer $P_1$ is set in the register B (Step $S_{23}$), and then the pointer $P_1$ is incremented (Step $S_{24}$), and then the tempo counter 8 is cleared (Step $S_{25}$), and then the transfer register is set (Step $S_{26}$), and then the contents of the respective registers of the CPU 1 are restored. Accordingly, the state of storage of the respective event data in the memory RAM 1 immediately after said program SEDW is carried out will become as shown in FIG. 14(*b*).

Figure 15:
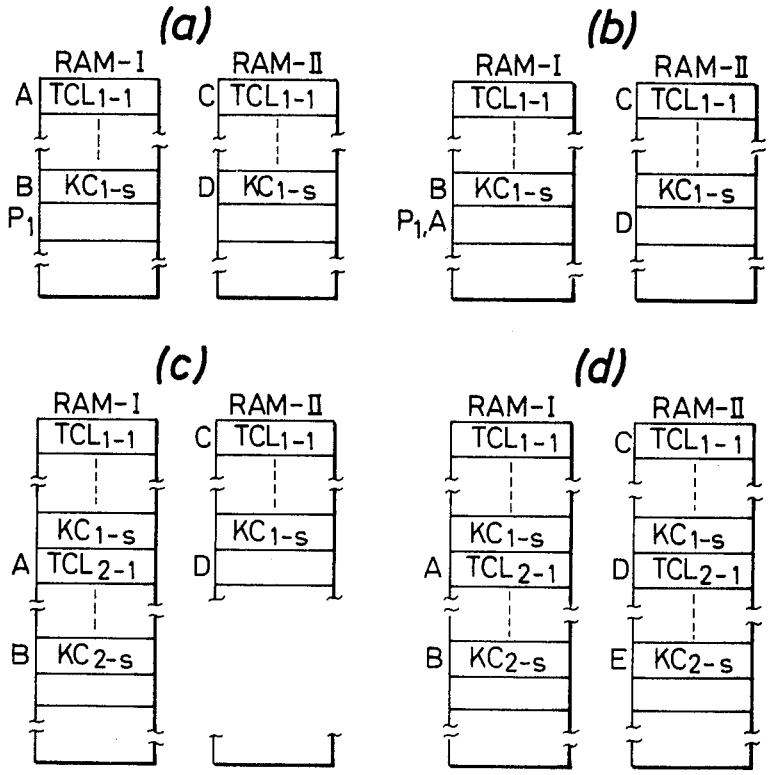
FIG. 15 is an illustration of the stored state of event data for explaining the operation of the program XFER.

Here, when the controlling action of the CPU 1 returns to Step $S_2$ of FIG. 9, the fact that the transfer register has changed into its set state in Steps $S_2$ and $S_3$ is detected, and, as a result, the program XFER of Step $S_9$ is carried out through Step $S_{4e}$. When the carrying-out of the program XFER is commenced, the transfer register is reset first in Step $S_{28}$ as shown by the flow chart of FIG. 12, and then the measure counter is incremented in Step $S_{29}$ (in this case, a change will be made from "0" to "1"). Thereafter, in Step $S_{30}$, judgement is made as to whether or not the value of the measure counter is more than "2". Since, in this instance, the value of said measure counter is "1", the control will advance to Step $S_{31}$ and the following operations are carried out. That is, firstly, the difference between the value of the register B and the value of the register A is added to the value of the register C, and the result of this addition is set in the register D. Then, the contents of the respective addresses ranging from the address pointed to by the value of the register A up to the address pointed to by the value of the register B in the memory RAM I are transferred to the respective addresses ranging from the address pointed to by the value of the register C up to the address pointed to by the value of the register D in the memory RAM II. As a result, the state of storage of the respective event data of the memories RAM I and RAM II will become as shown in FIG. 15(*a*). Then, in Step $S_{32}$ in the flow chart of this FIG. 12, the register D is incremented, and then in Step $S_{33}$ a value obtained by adding "1" to the value of the register B is set in the register A, and then in Step $S_{34}$, the value of the register A is set in the pointer $P_1$. As a result, those addresses pointed to by the registers A, B, C and D and by the pointer $P_1$, respectively, will become as shown in FIG. 15(*b*).

Furthermore, in case the instrument player continues key operations, the program KEDW is carried out each time the key operation state changes, in such a way as described above, and the event data will be stored successively in the respective addresses pointed to by the pointer $P_1$ in memory RAM I. And, let us here assume that, after the key operation has changed n times (this value n is not necessarily equal to the number n of key operation changes for the first measure) during the period of time corresponding to the second measure, the tempo count TCL again arrives at "192", and that, as a result, the program SEDW is carried out. Whereupon, the state of storage of the respective event data of the memories RAM I and RAM II as well as the addresses pointed to by the registers A, B, C and D at said timing will become as shown in FIG. 15(*c*). In this instance, the transfer register is set when said program SEDW is carried out.

Here, when the controlling action of the CPU 1 returns to Step $S_2$ of FIG. 9, the program XFER is carried out in a manner similar to that described above. Upon commencement of the program XFER, the transfer register is reset (Step $S_{28}$), and then the measure counter is incremented (Step $S_{29}$), and then judgment is made as to whether or not the vlaue of the measure counter is more than "2" (Step $S_{30}$). Since, in this instance, the value of the measure counter is "2", the control advances to Step $S_{35}$, wherein the following operations are carried out. That is, firstly, the difference between the value of the register B and the value of the register A is added to the value of the register D, and the result of this addition is set in the register E, and then the contents of the respective addresses ranging from the address pointed to by the value of the register A up to the address pointed to by the value of the register B in the memory RAM I are transferred to the respective addresses ranging from the address pointed to by the value of the register D up to the address pointed to by the value of the register E in the memory RAM II. As a result, the state of storage of the respective event data of the memories RAM I and RAM II as well as the addresses pointed to by the values of the respective registers A, B, C, D and E will become as shown in FIG. 15(*d*). Next, upon completion of this Step $S_{35}$, the control advances to Step $S_{36}$, wherein the program CORR is carried out, so that the performance data (aggregation of said respective event data) stored in the memory RAM II are processed.

Figure 5:
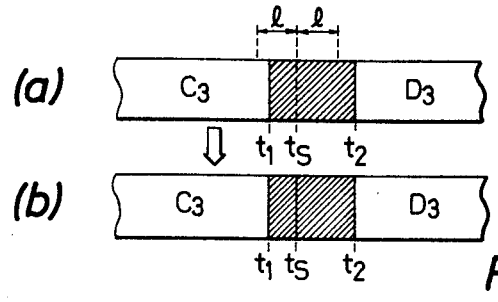
FIGS. 5 to 8 are time charts showing another embodiment in case performance data is processed by applying said principle.
Figure 6:
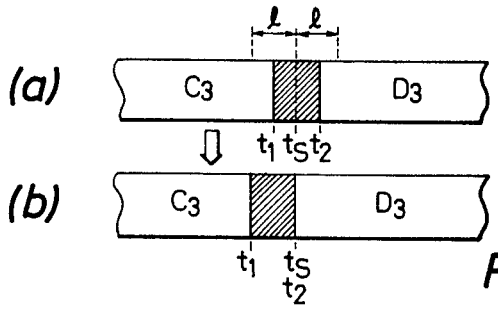
Figure 7:
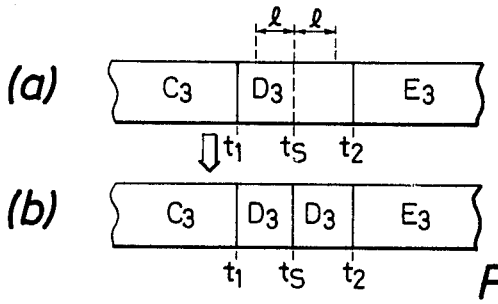
Figure 8:
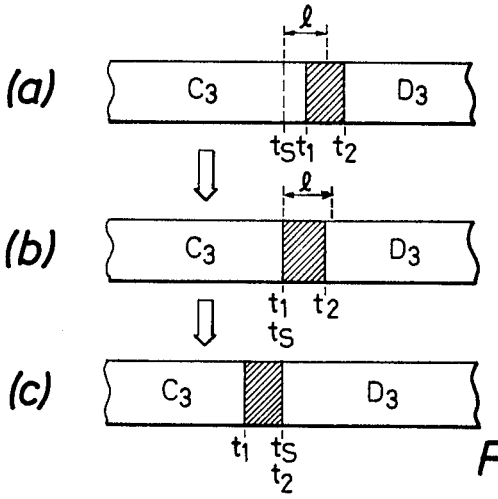

Hereunder, the course of processing this program CORR will be described, separately, with respect to: the key operation mode as shown in FIG. 2 (which will hereinafter be called Mode I), the key operation mode as shown in FIG. 3 (which will hereinafter be called Mode II), the key operation mode as shown in FIG. 4 or FIG. 6 (which will hereinafter be called Mode III), the key operation mode as shown in FIG. 8 (which will hereinafter be called Mode IV), and the key operation mode as shown in FIG. 5 or 7 (which will hereinafter be called Mode V), respectively.

Figure 16:
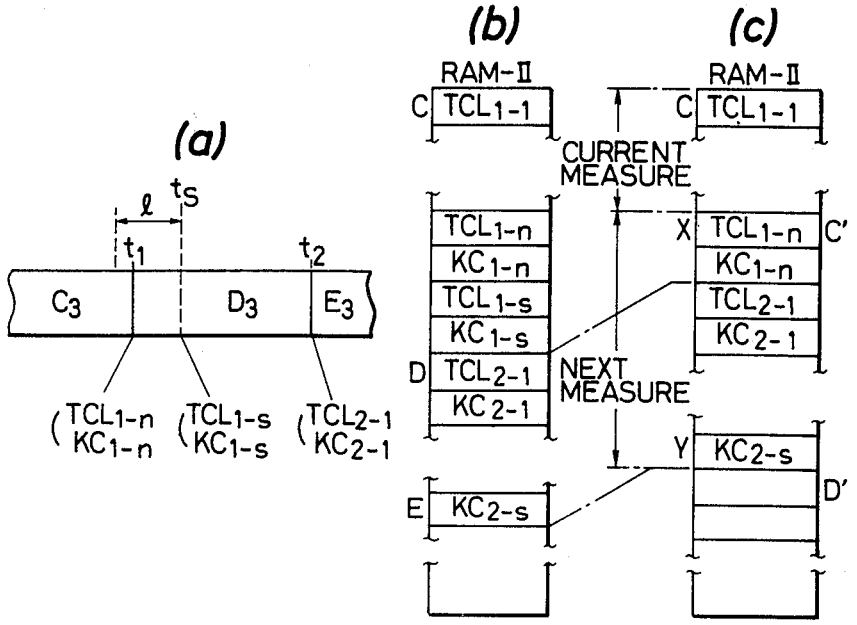
FIGS. 16 to 20 are illustrations for explaining the respective operations in Mode I to Mode V of said program CORR.

Description will be made, beginning with Mode I. This Mode I, as shown by the key operation change timing in FIG. 16(*a*), represents an instance that, for example, at timing $t_1$ which is within the period l immediately before a barline timing $t_s$ (in this case, this period l is a length of time corresponding to 12 counts of the tempo clocks), there takes place a key depression change from key $C_3$ over to key $D_3$, and also, at timing $t_2$ after the lapse of the period l from said timing $t_s$, a key depression change is conducted from said key $D_3$ over to key $E_3$. In such case, the event data at timing $t_1$ are a tempo count $TCL_{1-n}$ at said timing $t_1$ and a key code $KC_{1-n}$ corresponding to key $D_3$; and also the event data at timing $t_s$ are a tempo count $TCL_{1-s}$ (=192) at said timing $t_s$ and a key code $KC_{1-s}$ corresponding to key $D_3$; and also the event data at timing $t_2$ are tempo count $TCL_{2-1}$ at said timing $t_2$ and a key code $KC_{2-1}$ corresponding to key $E_3$. And, in this case, the state of storage of the respective event data in the memory RAM II as well as the addresses pointed to by the respective registers C, D and E are rendered to such pattern as ashown in FIG. 16(*b*) in such manner as shown already in FIG. 15(*d*). Here, upon commencement of the carrying-out of the program CORR shown in FIG. 13, judgement is made first as to whether or not the conditions that, in Step $S_{50}$, the key code $KC_{1-n}$ is equal to the key code $KC_{1-s}$ and also that the difference between the tempo count $TCL_{1-s}$ and the tempo count $TCL_{1-n}$ is smaller than the period l, i.e. less than the value "12", have been established (provided, however, in this flow chart, the sufix i is designated as "1", and the sufix j is designated as "2"). Since, in this instance, the abovesaid conditions have been established, the control advances to Step $S_{51}$ wherein the event data of the respective addresses ranging from the address pointed to by the value of the register D up to the address pointed to by the value of the register E are transferred to the respective addresses ranging from the address pointed to by the value obtained by substracting "2" from the value of the register D up to the address pointed to by the value obtained by subtracting "2" from the value of the register E (i.e. shifted for two addresses). Next, in Step $S_{52}$, a value obtained by subtracting "4" from the value of the register D is set in a register X, and the value obtained by substracting "2" from the value of the register E is set in a register Y. As a result, the state of storage of the respective event data in the memory RAM II as well as the addresses pointed to by the registers C, X and Y will become as shown in FIG. 16(*c*). Here, the register C is one intended to point to the leading address in the area wherein the performance data of the current measure (the measure which is to be printed out) is stored. Also, the register X is one for pointing to the leading address in the area wherein the performance data of the next measure is stored. Accordingly, due to said processing of Step $S_{50} \sim S_{52}$, the barline timing $t_s$ in FIG. 16(*a*) has been amended to be the timing $t_1$ for the time being. And, with the completion of this program CORR, the control advances to Step $S_{37}$ in FIG. 12, wherein the time length of the current measure which has been prolonged or shortened by said amendment is adjusted so as to become a standard time length. More particularly, in this case, the duration of the current measure has been shortened by a length of time corresponding to the difference between the timing $t_1$ and the timing $t_s$ in FIG. 16(*a*). Therefore, the durations of the respective notes and rests provided within the current measure are all proportionally adjusted, according to an already known method, in such a way that the duration of this current measure will become the standard time length (a duration amounting to 192 counts of tempo clocks). It should be understood here that, during this adjustment, there is conducted a processing to eliminate, by a known method, a rest which is shorter than the period l. Also, in this Step $S_{37}$, there are conducted processings such as to round off the durations of respective notes and rests, or such that, in case a dotted 8-th note is followed by a 16-th rest, they are collectively regarded as a 4-th note. Upon completion of these adjustments, the control advances to Step $S_{38}$ and the state of the print end register is judged. Since, in this case, said register is in its reset state, the control advances further to Step $S_{39}$. In this Step $S_{39}$, the data of the respective addresses ranging from the address pointed to by the value of said register C up to the address pointed to by the value of the register X, i.e. the music score data of the current measure and the first tempo count of the next measure, are outputted to the printer controlling circuit 11, whereby the music score of the current measure is printed out. It should be noted here that the reason why, in such instance, the first tempo count of the next measure is outputted to the printer controlling circuit 11 is because this tempo count becomes necessary in order to determine the duration of either the last note or rest of the current measure. Next, upon completion of this Step $S_{39}$, the control advances to Step $S_{40}$, wherein the content of the register C is renewed into the value of the register X, and also the content of the register D is renewed into a value obtained by adding "1" to the value of the register Y, and thus there is made a preparation for the processing of the performance data of the next measure. It should be noted here that the addresses pointed to by the values of these registers C and D are indicated as C' and D', respectively, in FIG. 16(*c*).

Figure 13:
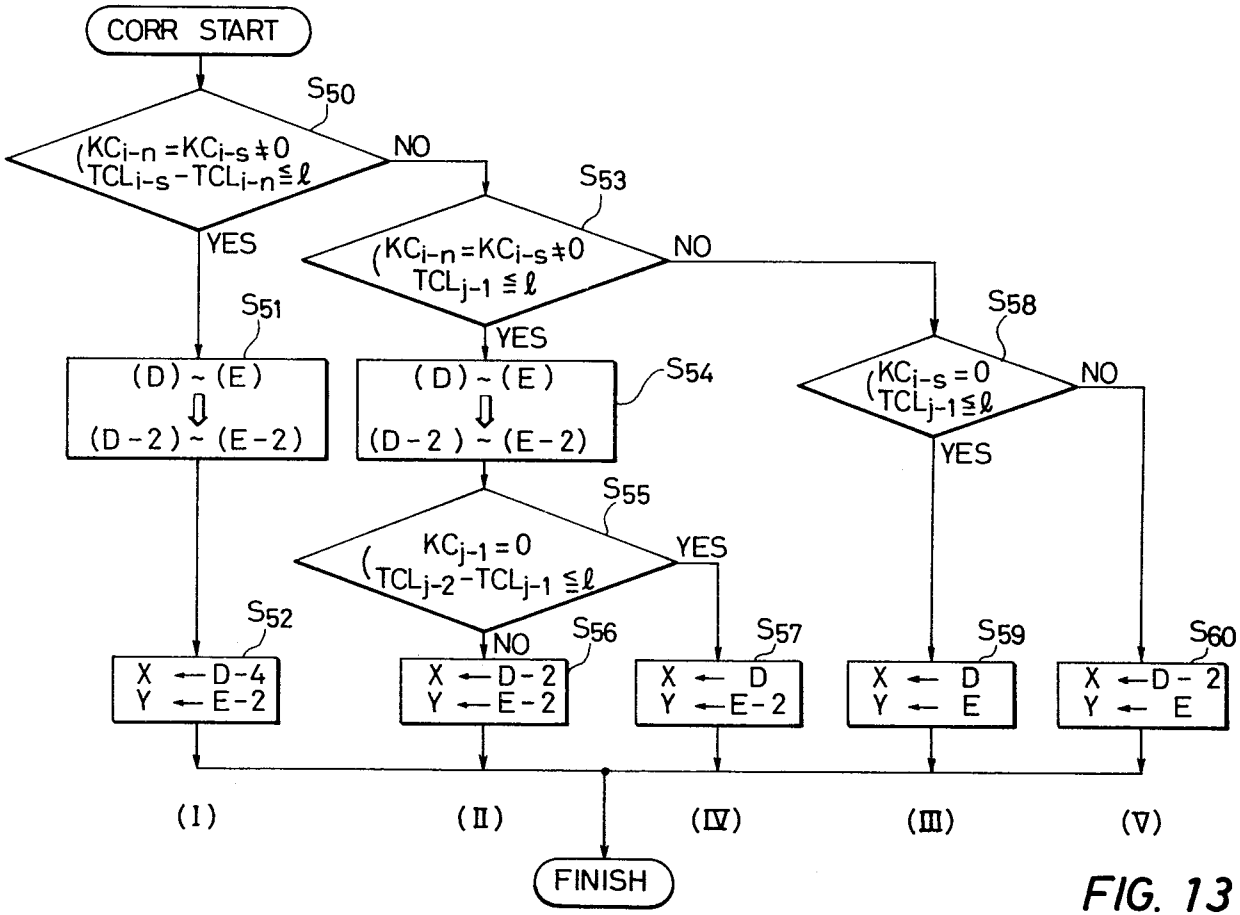
FIG. 13 is a flow chart of a program CORR in said program XFER.
Figure 17:
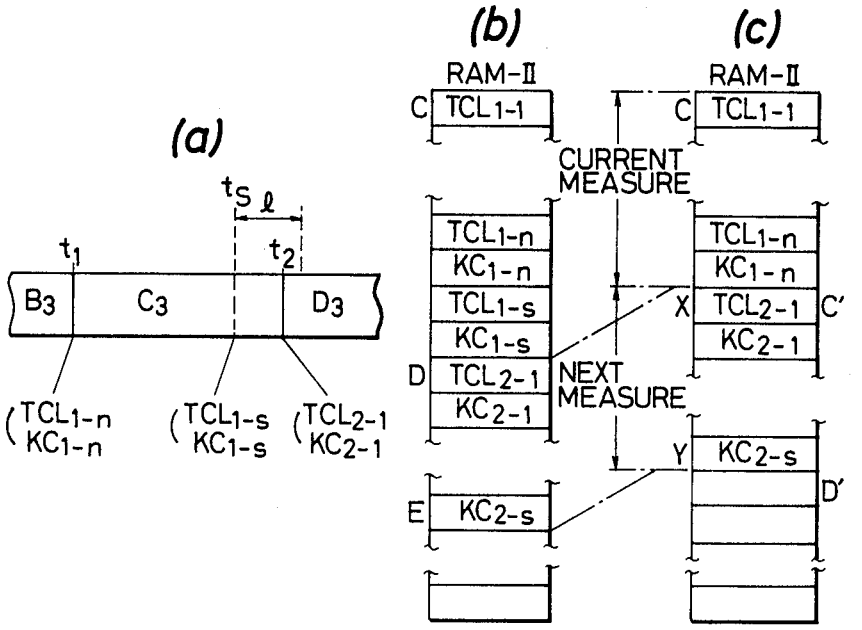

Next, description will be made of the processing of performance data in Mode II. As shown by the timing chart in FIG. 17(*a*), this Mode II represents the instance wherein, for example, a key depression change is effected from key $B_3$ over to key $C_3$ at timing $t_1$ a key depression change from key $C_3$ over to key $D_3$ is conducted at timing $t_2$ which locates within the period l immediately after the barline timing $t_s$. In such instance, the event data at timing $t_1$ are a tempo count $TCL_{1-n}$ at said timing $t_1$ and a key code $KC_{1-n}$ corresponding to key $C_3$. Also, the event data at timing $t_s$ are a tempo count $TCL_{1-s}$ (=192) at said timing $t_s$ and a key code $KC_{1-s}$ corredponding to key $C_3$. Also, the event data at timing $t_2$ are a tempo count $TCL_{2-1}$ at said timing $t_2$ and a key code $KC_{2-1}$ corresponding to key $D_3$. Also, in this case, the state of storage of the respective event data in the memory RAM II as well as the addresses pointed to by the respective registers C, D and E are as shown FIG. 16(*b*). When the carrying-out of the program CORR shown in FIG. 13 is started here, there is conducted the judgment of Step $S_{50}$. Since, in this case, the difference between the tempo count $TCL_{1-s}$ and the tempo count $TCL_{1-n}$ is greater than the value "12" corresponding to the period l, the control will advance to Step $S_{53}$. In this Step $S_{53}$, judgment is made as to whether or not the conditions that the key code $KC_{1-n}$ is equal to the key code $KC_{1-s}$ and also that the tempo count $TCL_{2-1}$ is less than the value "12" corresponding to the period l are established. Since, in this instant case, the above-mentioned conditions have been established, the control advances to Step $S_{54}$. In this Step $S_{54}$, the event data of the respective addresses ranging from the address pointed to by the value of the register D up to the address pointed to by the value of the register E are transferred to the respective addresses ranging from the address pointed to by a value obtained by subtrancting "2" from the value of the register D up to the address pointed to by the value obtained by subtracting "2" from the value of the register E. Then, judgment is made in Step $S_{55}$ as to whether or not the conditions that the key code $KC_{2-1}$ is "0" and that the difference between the tempo count $TCL_{2-2}$ and the tempo count $TCL_{2-1}$ is less than the value "12" will be established. Since, in this instant case, these conditions do not establish, the control advances to Step $S_{56}$, wherein a value obtained by subtracting "2" from the value of the register D is set in the register X, and also a value obtained by subtracting "2" from the value of the register E is set in the register Y. As a result of the foregoing operations, the state of storage of the respective event data in the memory RAM II at said timing as well as the addresses pointed to by the registers C, X and Y will become as shown in FIG. 17(*c*). That is, in this instant case, the barline timing $t_s$ is amended to timing $t_2$ for the time being. It should be noted here that the course of the performance data processing subsequent to the abovesaid processing is similar to that described in connection with the Mode I.

Figure 18:
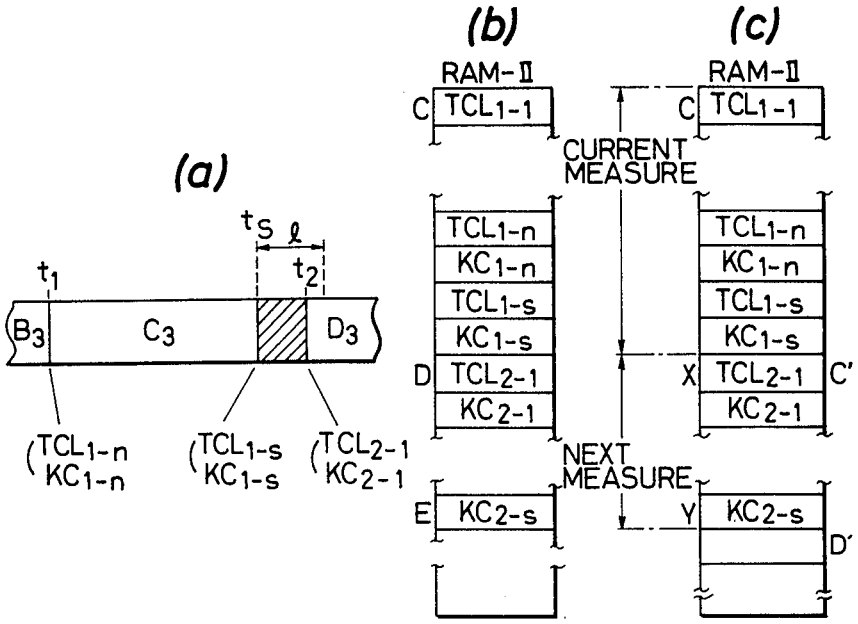

Next, description will be made of the processing of performance data in Mode III. This Mode III, represents an instance, as indicated by the timing chart in FIG. 18(*a*), that there is conducted a key depression change, for example, from key $B_3$ over to key $C_3$ at timing $t_1$; and key $C_3$ is released at the barline timing $t_s$, thus providing the state of no key depression; and the depression of key $D_3$ is started at timing $t_2$ whithin the period l which is immediately after said timing $t_s$. The state of storage of the event data in the memory RAM II in this instance is as shown in FIG. 18(*b*). Here, upon commencement of the carrying-out of the program CORR shown in FIG. 13, it should be noted that since the conditions are not established in either Step $S_{50}$ or Step $S_{53}$, so that the control advances to Step $S_{58}$, wherein judgment is made as to whether or not the conditions that the key code $KC_{1-s}$ is "0" (which is the key code of a rest) and that the tempo count $TCL_{2-1}$ is less than the value "12" are established. In this instance, however, said conditions are established, so that the control advances to Step $S_{59}$. In this Step $S_{59}$, the value of the register D is set in the register X, and also the value of the register E is set in the register Y. As a result, the state of storage of the respective event data in the memory RAM II as well as the addresses pointed to by the registers C, X and Y will be as shown in FIG. 18(*c*). That is, in this case, the barline timing $t_s$ is amended to timing $t_2$ for the time being. It should be noted here that the course of performance data processing after the abovesaid processing is similar to that of the Mode I.

Figure 19:
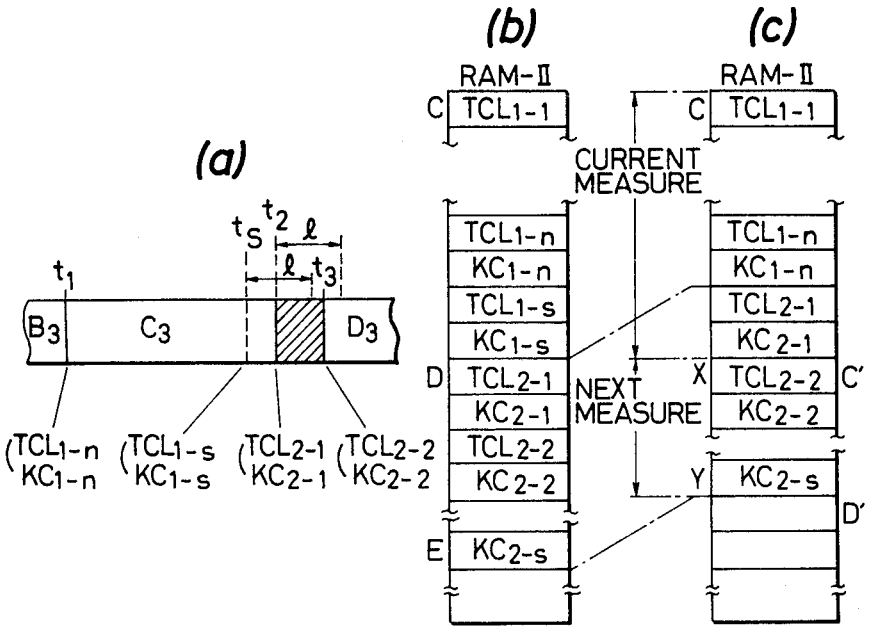

Next, Mode IV will be described. This Mode IV is the instance, as shown by the timing chart in FIG. 19(*a*), that there is conducted a key depression change, for example, from key $B_3$ over to key $C_3$ at timing $t_1$; and key $C_3$ is released at timing $t_2$ within the period l immediately after the barline timing $t_s$, providing the state of no key depression; and the depression of the key $D_3$ is started at timing $t_3$ within the period l immediately after said timing $t_2$. The state of storage of the respective event data in the memory RAM II in such instance is as shown in FIG. 19(*b*). Here, upon commencement of the carrying-out of the program CORR shown in FIG. 13, the control advances in the order: Step $S_{50}$→Step $S_{53}$→Step $S_{54}$→Step $S_{55}$ in the same way as in the case of Mode II. In this Step $S_{55}$, judgment is made as to whether or not the conditions that the key code $KC_{2-1}$ is "0" (is a rest) and that the difference between the tempo count $TCL_{2-2}$ and the tempo count $TCL_{2-1}$ is less than the value "12" are established. Since, in this instance, said conditions are established, the control advances to Step $S_{57}$, wherein the value of the register D is set in the register X, and a value obtained by subtracting "2" from the value of the register E is set in the register Y. As a result, the state of storage of the respective event data in the memory RAM II as well as the addresses pointed to by the registers C, X and Y will become as shown in FIG. 19(*c*). That is, this instance represents that the barline timing $t_s$ is amended to timing $t_3$ for the time being. It should be noted here that the course of the performance data processing after said processing has been conducted in a way similar to that of the Mode I.

Figure 20:
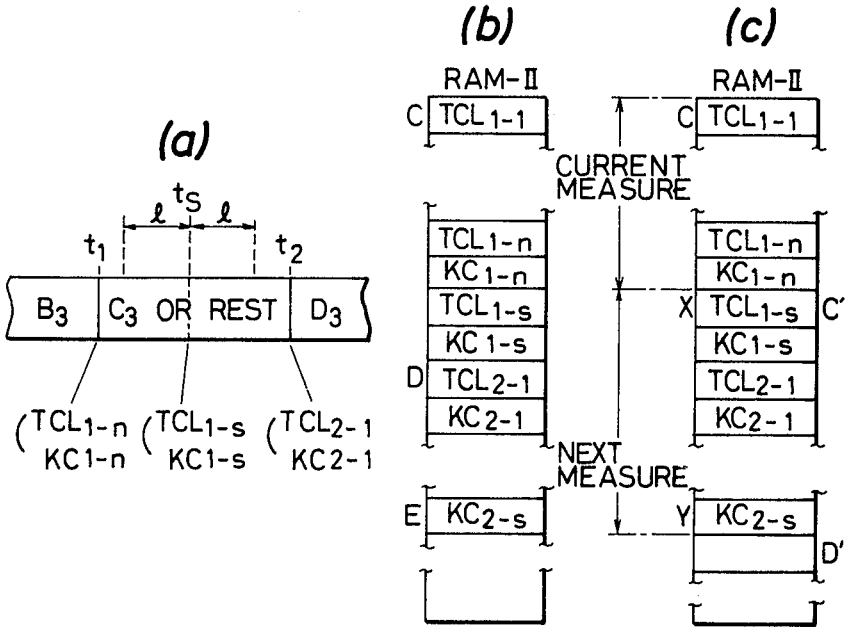

Next, Mode V will be described. This Mode V represents an instance as indicated by the timing chart in FIG. 20(*a*), that there is conducted, for example, a key depression change from key $B_3$ over to key $C_3$ at timing $t_1$ (or there is provided the state of no key depression); and there is conducted a key depression change from key $C_3$ over to key $D_3$ at timing $t_2$ (or the depression of key $D_3$ is started from the no key depression state); and that timing $t_1$ is prior by more than the period l to the barline $t_s$, and that timing $t_2$ is later by more than the period l than the barline timing $t_s$. In this case, the state of storage of the respective data in the memory RAM II is as shown in FIG. 20(*b*). Here, upon commencement of the carrying-out of the program CORR shown in FIG. 13, it will be noted that since the conditions of Step $S_{50}$ and Step $S_{53}$ are not established either, the control will advance to Step $S_{58}$, wherein judgment is made as to whether or not the conditions that the key code $KC_{1-s}$ is "0" and that the tempo count $TCL_{2-1}$ is less than the value "12" are established. Since, in this case, said conditions are not established, the control advances to Step $S_{60}$, wherein a value obtained by subtracting "2" from the vaue of the register D is set in the register X, and also the value of the register E is set in the register Y. As a result, the state of storage of the respective event data in the memory RAM II as well as the addresses pointed to by the registers C, X and Y will become as shown in FIG. 20(*c*). That is, in this case, amendment of the barline timing $t_s$ is not conducted. It should be noted here that the course of the performance data processing after the completion of this program CORR is similar to that of Mode I.

The above are the operations carried out in the music score printing-out mode.

Next, description will be made of the instance wherein, in the music score printing-out mode, the instrument player deactuates (turn off) the print start switch to terminate the printing-out of the music score.

In this instance, due to the deactuation of the print start switch, the state of the print start register varies into the reset state, so that the print end register is set in Step $S_7$ of FIG. 9. This Step $S_7$ is carried out also even in case the instrument player does not conduct a key operation for a period of time longer than a predetermined length of time. And, when the program SEDW is carried out at the first barline timing following the setting of this print end register, processing is carried out in the order: Step $S_{17}$→Step $S_{19}$→Step $S_{20}$→ . . . →Step $S_{27}$ in the flow chart of FIG. 11, and thus the event data at said barline timing are stored, and concurrently therewith the transfer register is set. As a result, the program XFER in Step $S_9$ of FIG. 9 is carried out. When this program XFER is carried out, the control advances in the order of $S_{28}$, $S_{29}$, $S_{30}$, $S_{35}$, $S_{36}$ and $S_{37}$ in FIG. 12. And, in Step $S_{38}$, the state of the print end register is judged. Since, in this instance, said register is in its set state, the control advances to Step $S_{41}$. In this Step $S_{41}$, the event data of the respective addresses ranging from the address pointed to by the value of the register C up to the address pointed to by the value of the register Y are outputted to the printer controlling circuit 11, so that the music score of the final measure is printed out. And then, in Step $S_{42}$, the print end register is reset, and then, in Step$_{43}$, all the registers, pointers and so forth which are related to the printing-out of the music score are initialized.

The above are the operations which are carried out when the print start switch is deactuated.

It should be noted here that, in case an automatic performance is to be conducted in this embodiment, it is only necessary to successively read out the respective event data of the memory RAM II, beginning at the leading one, and to output the resulting read-out key code KC to the tone signal forming circuit 9 only for a time length corresponding to the read-out tempo count TCL.

What is claimed is:

1. A method of processing performance data, comprising:

forming performance data comprising note event data indicative of a start timing of respective notes and rests, and note pitch data indicative of pitches of said notes or indicative of said rests by absense of a note pitch therein, said note event data and said note pitch data constituting a music progression;

forming barline data comprising barline event data indicative of barline timings for drawing respective barlines which appear at a predetermined time interval defining a measure for the music progression, and note pitch data indicative of pitches of the notes or indicative of the rests at respective barline timings;

judging whether or not said note pitch data of said barline data indicates a note pitch, and whether or not difference in time length between said barline timing and said start timing of a note or rest of said performance data which is present immediately before or after said barline timing is smaller than a predetermined length of time; and adjusting, based on a result of said judgment, said start timing of a note or rest with respect to the barline timing.

2. A method according to claim 1, in which:

in case, as a result of said judgment, the note pitch data of the barline data represents a note pitch and the difference in time length between the barline timing and the start timing of a note of the performance data which is present immediately before said barline timing is smaller than said predetermined length of time, said start timing of said note is adjusted to fall on the barline timing in the performance date.

3. A method according to claim 2, in which:

in case, as a result of said judgment, the note pitch data of the barline data represents a note pitch and the difference in time length between the barline timing and the start timing of a note or a rest of the performance data which is present immediately after the barline timing is smaller than said predetermined length of time, said start timing of said note or rest is adjusted to fall on the barline timing in the performance data.

4. A method according to claim 1, in which:

in case, as a result of said judgment, the note pitch data of the barline data does not represent a note pitch and the difference in time length between the barline timing and the start timing of a note of the performance data which is present immediately after the barline timing is smaller than said predetermined length of time, said start timing of said note is adjusted to fall on the barline timing in the performance data.

5. A method according to claim 1, in which:

in case the start timing of a note pitch data of the performance data, as adjusted as a result of said judgment to fall on the barline timing in the performance data, represents a rest and the difference in time length between said barline timing and a start timing of a note subsequent thereto is smaller than the predetermined length of time, the start timing of the latter-mentioned note is now adjusted to fall on the barline timing in the performance data.

* * * * *